US005634441A

United States Patent [19]

Ragain

[11] Patent Number: 5,634,441

[45] Date of Patent: Jun. 3, 1997

[54] POWER TRANSFER MECHANISM

[75] Inventor: W. Parker Ragain, 873 Goddard St., Alcoa, Tenn. 37701

[73] Assignee: W. Parker Ragain, Knoxville, Tenn.

[21] Appl. No.: 586,283

[22] Filed: Jan. 16, 1996

[51] Int. Cl.[6] ..... F02B 75/24

[52] U.S. Cl. ..... 123/54.3; 123/55.3

[58] Field of Search ..... 123/54.3, 55.3, 123/197.3, 54.2, 55.4, 55.5

[56] References Cited

U.S. PATENT DOCUMENTS

| | | | |
|---|---|---|---|
| 717,445 | 12/1902 | Nestius . | |
| 871,707 | 11/1907 | Koch . | |
| 1,309,257 | 7/1919 | Martins . | |
| 1,355,451 | 10/1920 | Carpenter . | |
| 1,445,474 | 2/1923 | Benson . | |
| 1,594,045 | 7/1926 | Caminez . | |
| 1,765,237 | 6/1930 | King | 123/54.3 |
| 1,774,087 | 8/1930 | Dunn . | |
| 1,792,062 | 2/1931 | Barnum | 123/55.3 |
| 1,810,688 | 6/1931 | Toce et al. | 123/55.3 |
| 1,830,046 | 11/1931 | White . | |
| 1,863,877 | 6/1932 | Rightenour . | |
| 1,931,401 | 10/1933 | Baisden . | |
| 1,965,548 | 7/1934 | Hart . | |
| 2,120,657 | 6/1938 | Tucker . | |
| 2,124,604 | 7/1938 | Bidwell . | |
| 2,252,153 | 8/1941 | Anthony | 123/197.3 |
| 3,572,209 | 3/1971 | Aldridge | 123/55.3 |
| 3,584,610 | 6/1971 | Porter | 123/44 E |
| 3,604,402 | 9/1971 | Hatz | 92/72 |
| 4,331,108 | 5/1982 | Collins | 123/41.35 |
| 4,414,930 | 11/1983 | Hume | 123/197.3 |
| 4,493,296 | 1/1985 | Williams | 123/54.3 |
| 4,545,336 | 10/1985 | Waide | 123/55.3 |
| 4,697,552 | 10/1987 | Kolev | 123/55.3 |
| 5,331,926 | 7/1994 | Vaux et al. | 123/55.3 |

FOREIGN PATENT DOCUMENTS

| | | | |
|---|---|---|---|
| 471793 | 5/1952 | Italy | 123/197.3 |

*Primary Examiner*—David A. Okonsky

[57] ABSTRACT

A power transfer mechanism for transferring power between rotating components and reciprocating components includes a cam rotatable about an axis and having an odd number of lobes evenly spaced therearound, and a double acting reciprocating member which includes two diametrically opposed pistons, each of which is connected rigidly to a roller follower in operable relationship with the cam, and connecting means disposed between the pistons for resiliently urging the roller followers against the cam.

4 Claims, 4 Drawing Sheets

POWER TRANSFER MECHANISM

FIELD OF INVENTION

The present invention relates to devices which transfer power between rotating components and reciprocating components, and more particularly to such devices wherein a rotating component comprises a cam having an odd number of lobes, and wherein a reciprocating component comprises opposed pistons resiliently interconnected and which move generally in concert.

BACKGROUND OF THE INVENTION

Devices for transferring power between rotating components and reciprocating components are used in various applications, especially piston type gas compressors and internal combustion engines. Many variations have been designed, with varying levels of success. The most common central element is usually a crank or a cam. The present invention represents an improvement in a cam type device, especially wherein the cam has an odd number of lobes.

A major problem which has been encountered with prior cam type devices is the effective return of the reciprocating element back toward the cam during negative cam pressure, after the reciprocating element has passed the top of a lobe. Various mechanisms have been devised to resolve this problem, but many are complicated, cumbersome, mechanically weak, cause loss of efficiency and/or costly.

Some engine mechanisms solve the above stated problem by using a double-acting reciprocating element with diametrically opposed pistons rigidly fixed at either end thereof, each piston having a roller follower in contact with the cam. The firing of one piston causes the return of the other piston. However, unless the cam has a constant diameter, the roller follower of the returning piston will briefly separate from the cam, causing what is known as "piston slap" an undesirable event for a device which is subject to any significant load. Moreover, a small amount of wear even in a constant diameter cam can cause looseness which results in the same event. A means is needed for maintaining contact of opposing roller followers with the cam, and take up any slack due to wear.

Some engine designs use springs between the roller followers and pistons. Such an arrangement is considered impractical because of power loss caused by the spring absorbing energy from the piston as it is transferred to the roller follower. Other engines have springs located in both opposing pistons where complete disassembly of the engine is necessary for spring adjustment and heat is intense.

Listed herein below for further information are U. S. Patents which show examples of various transfer mechanisms:

1. U.S. Pat. No. 717,445, issued to O. B. Nestius on Dec. 30, 1902.
2. U.S. Pat. No. 871,707 issued to E. Koch on Nov. 19, 1907.
3. U.S. Pat. No. 1,309,257, issued to L. A. Martins on Jul. 8, 1919.
4. U.S. Pat. No. 1,355,451, issued to L. R. Carpenter on Oct. 12, 1920.
5. U.S. Pat. No. 1,445,474, issued to L. E. Benson et.al. on Feb. 13, 1923.
6. U.S. Pat. No. 1,594,045, issued to H. Caminez on Jul. 27, 1926.
7. U.S. Pat. No. 1,765,237, issued to F. H. King on Jun. 17, 1930.

8. U.S. Pat. No. 1,774,087, issued to William G. Dunn on Aug. 26, 1930.
9. U.S. Pat. No. 1,792,062, issued to O. G. Barnum on Feb. 10, 1931.
10. U.S. Pat. No. 1,810,688, issued to C. A. Toce et.al. on Jun. 16, 1931.
11. U.S. Pat. No. 1,830,046, issued to F. White on Nov. 3, 1931.
12. U.S. Pat. No. 1,863,877, issued to A. L. Rightenour on Jun. 21, 1932.
13. U.S. Pat. No. 1,931,401, issued to B. L. Baisden on Oct. 17, 1933.
14. U.S. Pat. No. 1,965,548, issued to A. L. Hart on Jul. 3, 1934.
15. U.S. Pat. No. 2,120,657, issued to H. R. Tucker on Jun. 14, 1938.
16. U.S. Pat. No. 2,124,604, issued to W. B. Bidwell on Jul. 26, 1938.
17. U.S. Pat. No. 3,572,209, issued to H. F. Aldridge et.al. on Mar. 23, 1971.
18. U.S. Pat. No. 3,584,610, issued to Kilburn I. Porter on Jun. 15, 1971.
19. U.S. Pat. No. 3,604,402, issued to Ernst Hatz on Sep. 14, 1971.
20. U.S. Pat. No. 4,331,108, issued to Brian S. Collins in May 25, 1982.
21. U.S. Pat. No. 4,493,296, issued to Gerald J. Williams on Jan. 15, 1985.
22. U.S. Pat. No. 4,545,336, issued to William M. Waide on Oct. 8, 1985.
23. U.S. Pat. No. 4,697,552, issued to Nikola T. Kolev on Oct. 6, 1987.

OBJECT OF THE INVENTION

Accordingly, it is an object of the present invention to provide a new and improved cam type power transfer mechanism for transferring power between rotating components and reciprocating components, which provides the effective return of the reciprocating element back toward the cam during negative cam pressure. Moreover, it is also an object of the present invention to provide a means for maintaining contact of opposing roller followers with the cam, and take up any slack due to wear. Such means operates without interfering with the direct transferral of power from the piston to the cam. Such means allows one coil spring on the pistons interconnecting rod instead of two. Coil spring, gas cylinder, hydraulic device or whatever designer chooses as a resilient means can be adjusted through access means located on the cam case.

Further and other objects of the invention will become apparent from the description herein.

SUMMARY OF THE INVENTION

In accordance with one aspect of the present invention, the foregoing and other objects are achieved by a power transfer mechanism for transferring power between rotating components and reciprocating components. The device includes a cam rotatable about an axis and having an odd number of lobes evenly spaced therearound, and a double-acting reciprocating member which includes two diametrically opposed pistons, each of which is connected rigidly to a roller follower in operable relationship with the cam, and connecting means disposed between the two pistons for resiliently urging the roller followers against the cam.

For a better understanding of the present invention, together with other and further objects, advantages and capabilities thereof, reference is made to the following disclosure and appended claims in connection with the above-described drawings.

DETAILED DESCRIPTION OF THE INVENTION

The preferred embodiment of the invention is an internal combustion engine, although use in other engines, pumps, and other applications is also feasible.

Figure 1:
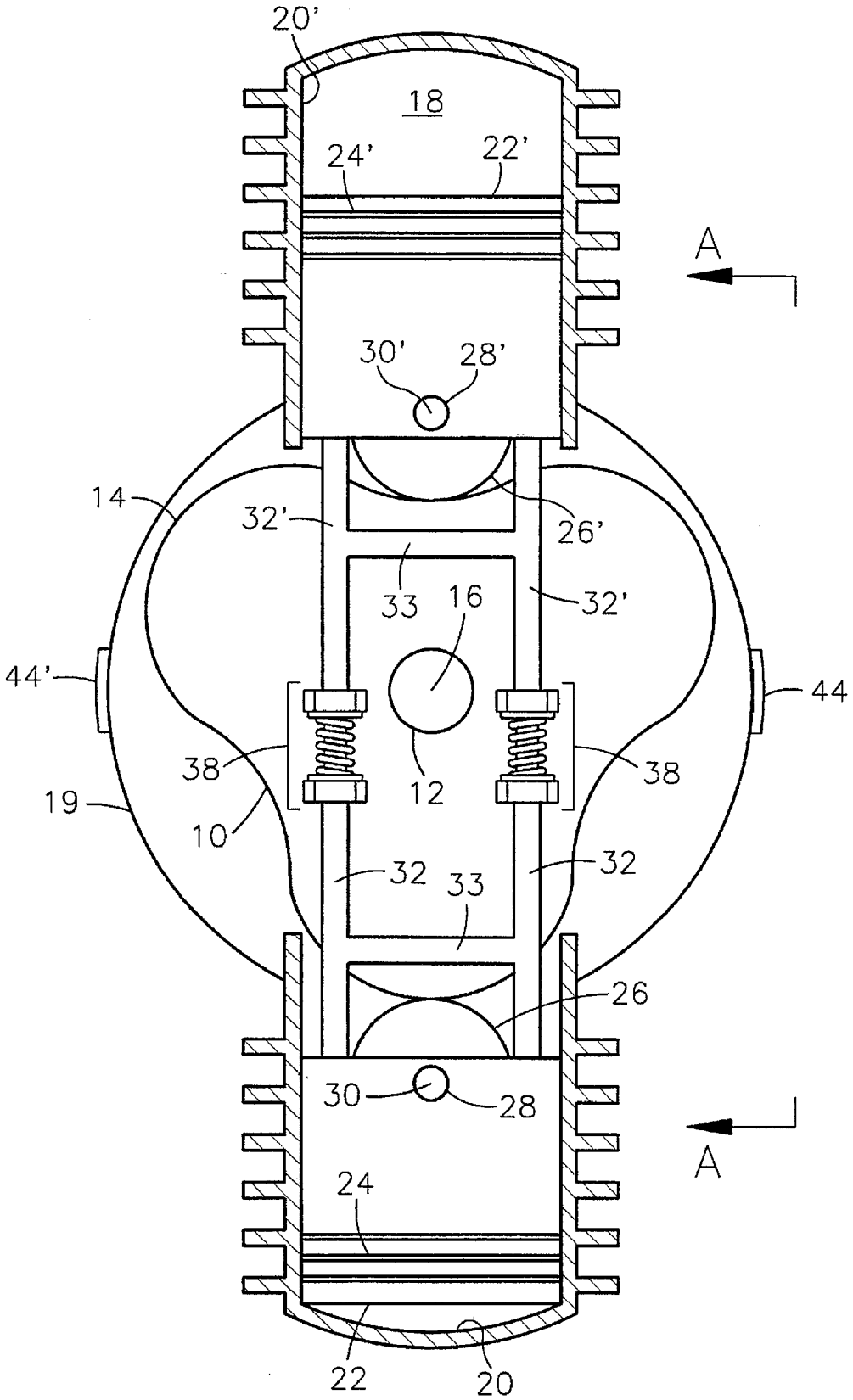
FIG. 1 is a schematic view of an embodiment of the invention through the axis of cam rotation and perpendicular to the piston center line.
Figure 2:
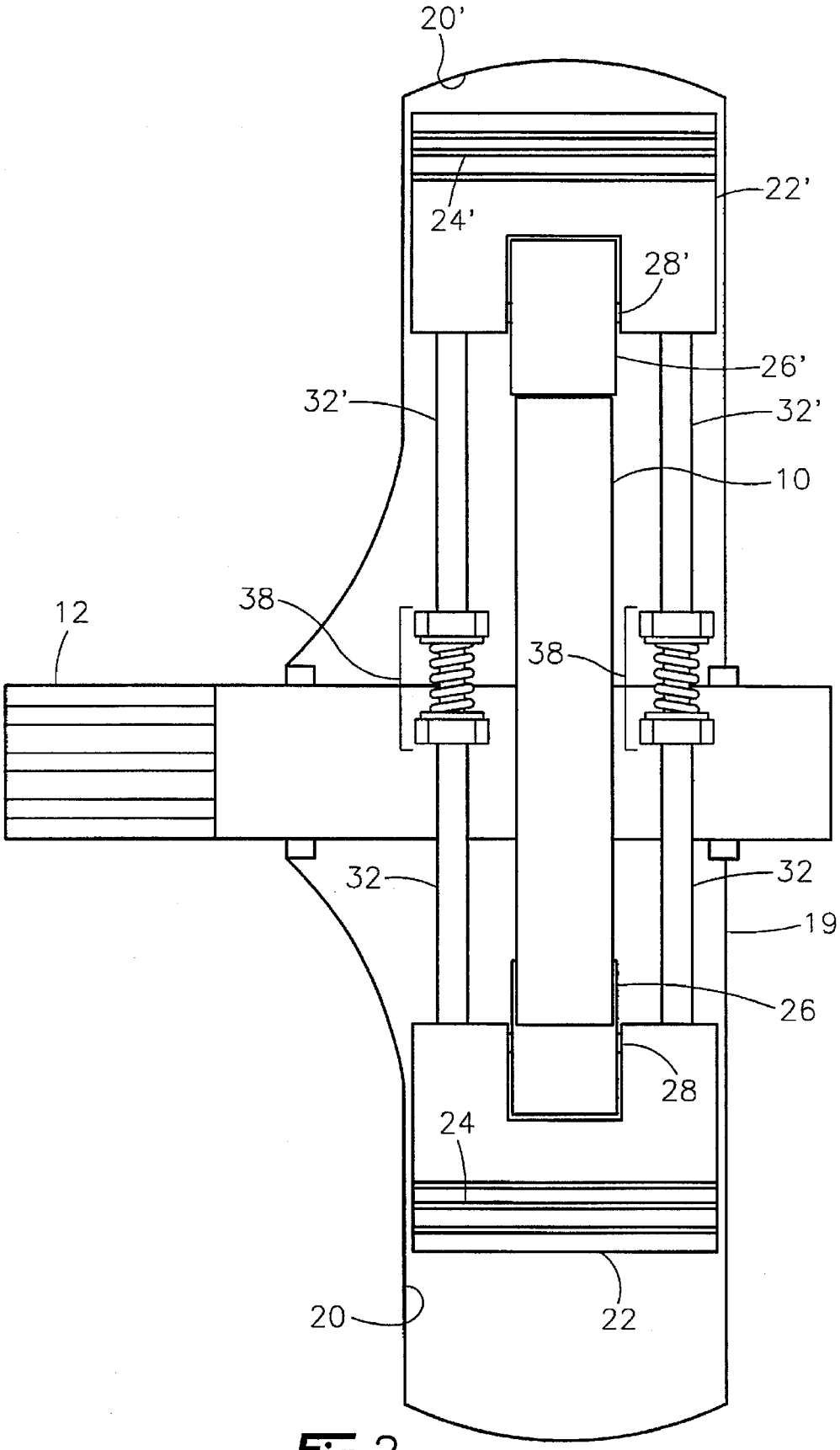
FIG. 2 is a schematic view, perpendicular to the axis of cam rotation and perpendicular to the piston center line, of the embodiment of the invention shown in FIG. 1, shown therein by arrows A.
Figure 3:
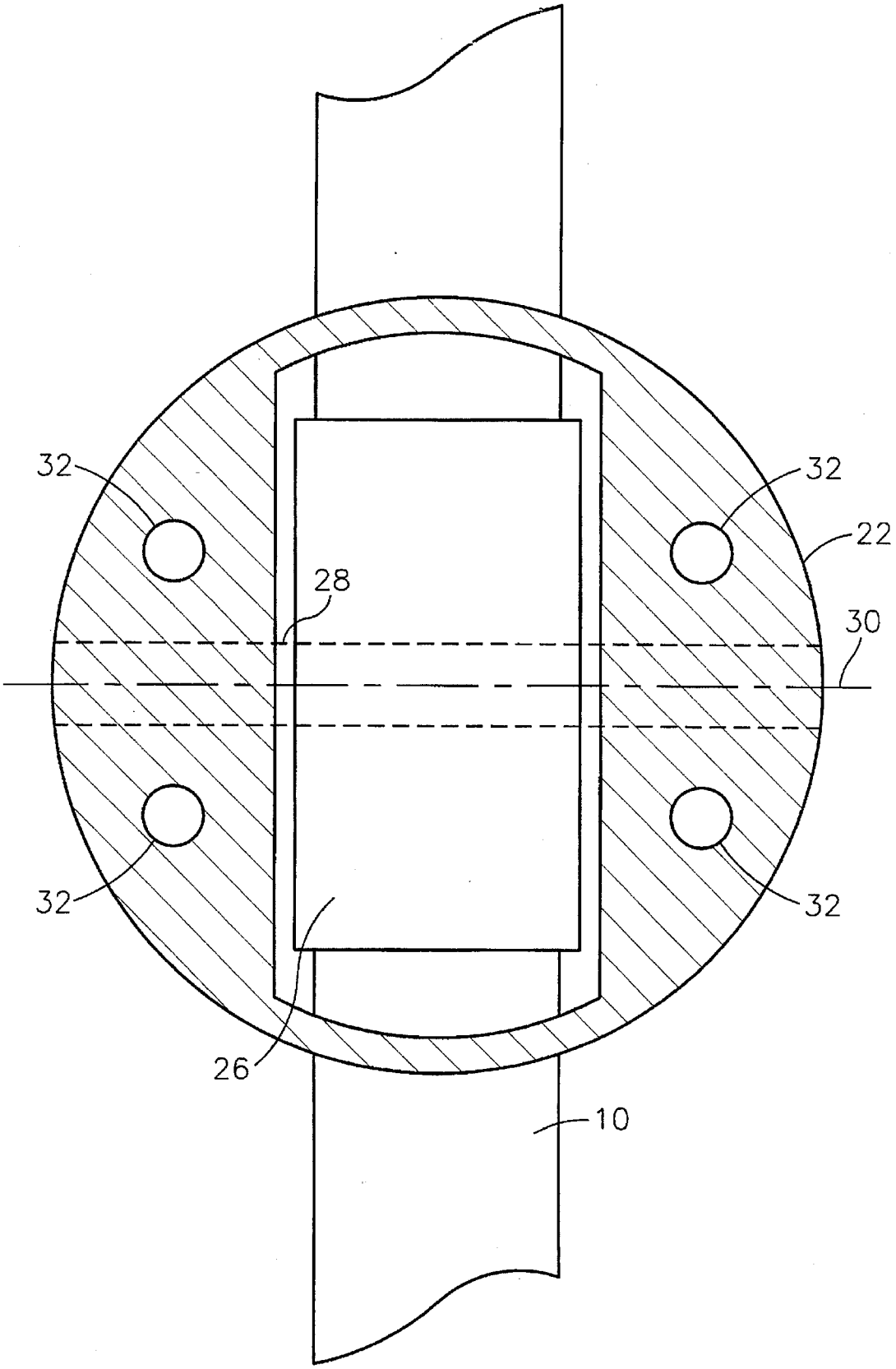
FIG. 3 is a top schematic view of a piston, showing the location of the ends of the four interconnecting rods.
Figure 4:
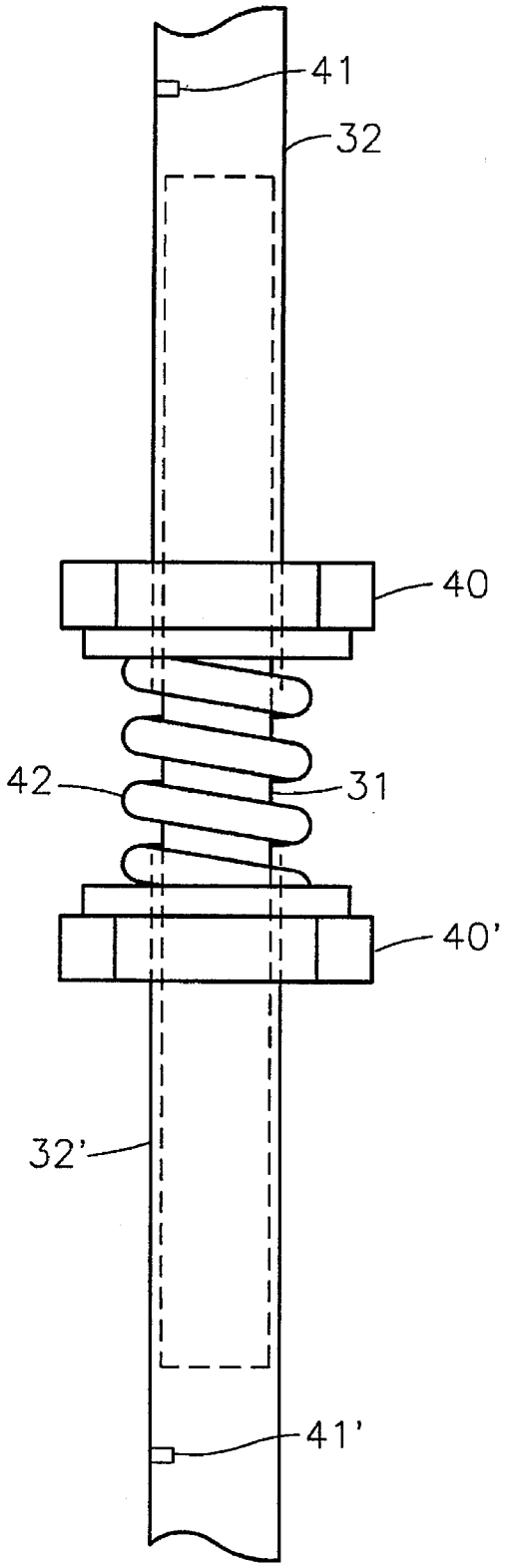
FIG. 4 is a schematic view of a resilient assembly.

Reference is made to FIGS. 1–4, wherein like elements are labeled with like numerals. A cam 10 and power output shaft 12 assembly or unit has an odd number of lobes 14. The lobes 14 number preferably one, three, five or seven, most preferably three. The cam 10 and power output shaft 12 assembly is rotatable about a power output shaft axis 16.

Diametrically opposed, conventional internal combustion engine cylinders 20, 20' are in conventional operative relationship with pistons 22, 22'. The engine cylinders are attached to the cam case 19. The cylinders 20, 20' are aligned along a cylinder axis 18 which is perpendicular to the power output shaft axis 16. The pistons 22, 22' generally have conventional piston rings 24, 24'. Roller type followers, or roller followers 26, 26' are journaled to the pistons 22, 22' via roller follower shafts 28, 28'. The roller followers 26, 26' are in conventional operative relationship with the cam 10. As the roller followers 26, 26' rotate to absorb lateral force imparted thereon during operation of the mechanism, the roller follower shafts 28, 28' may rotate about roller follower shaft axes 30, 30', which are preferably perpendicular to the cylinder axis 18, while parallel to the power output shaft axis 16. Preferably however, the roller followers 26, 26' have self-contained bearings, and the roller follower shafts 28, 28' do not rotate, and can be non-rotatably in the pistons 22, 22' and/or the roller followers 26, 26'.

Piston interconnecting rods, hereinafter called outer rods 32, 32' serve as connecting means for resiliently urging the roller followers 26, 26' against the cam 10. The outer rods 32, 32' are preferably four in number, each passing through a different quadrant A, B, C, D defined by the cam 10 and power output shaft 12. Adjacent outer rods 32, 32' can be separate, or rigidly interconnected by a bracket 33, which can be in any convenient location along the length of the outer rods 32, 32'. It is thus evident that the outer rods 32, 32' can be of any desired shape or configuration, so long as clearance for the cam 10 and power output shaft 12 are allowed.

The advantages of the present invention allow for the diameter of the cam 10 to be inconstant by as much as 10%. However, even with a constant diameter cam 10, normal wear can eventually cause slight variations resulting in looseness if the outer rods 32, 32' so rigidly interconnect the pistons 22, 22' that the roller followers 26, 26' are always spaced apart by a constant distance (e.g. to fit a constant diameter cam 10 prior to onset wear condition). This condition results in the roller follower 26 of the returning piston 22 separating from the cam 10 at the location of wear or lesser diameter, causing what is known as "piston slap"—an undesirable event for a device which is subject to any significant load.

Therefore, in accordance with the present invention, means is provided for maintaining contact of opposing roller followers 26, 26' with the cam 10, and take up any slack due to wear or inconstancy of cam 10 diameter. Such means operates without interfering with the direct transferal of power from the piston to the cam.

The pistons 22, 22' are connected by outer rods 32, 32' with resilient means as follows. A resilient assembly 38, 38' is resiliently attached to the outer rods 32, 32' and consists of parts which fit and slide one within another comprising an inner rod 31 within outer rods 32, 32', adjustable means 40, 40' and coil spring 42 mounted between the adjustable means 40, 40'. Inner rod stops 41, 41' are located inside outer rods 32, 32'. Coil spring 42 attached to adjustable means 40, 40' is mounted in tension and draws the outer rods, over the inner rod 31, toward each other at all times. The resilient assembly 38, 38' is preferably adjustable, and is generally set to allow for a maximum expected cam 10 diameter. The means for adjusting the resilient assembly are conventional, 40, 40' preferably comprising lock nuts riding on threads (not illustrated). The adjustments are preferably made the same for each of the adjustable means 40, 40'. Access for adjustment of adjustable means 40, 40' is made through access means 44, 44' located on cam case 19.

In a two cycle engine, operation of the above described invention is as follows. As one piston 22 with roller follower 26 is forced inward during a power stroke, it transfers power to the cam 10. The cam 10 thus causes the compression stroke of the opposing piston 22'. The resilient assembly 38 urges the pistons 22, 22' and respective roller followers 26, 26' against the cam 10. The coil spring 42 is sufficiently stiff to prevent piston slap, while allowing a certain amount of separation of the pistons 22, 22'. The amount of separation can vary with engine design, and can be from as little as about 0.005 inch to 10% cam 10 diameter.

In a four cycle engine, cam 10 and/or flywheel energy assist in non-power piston strokes as in conventional engines, with pistons 22, 22' moving together as one unit as described hereinabove.

It can be seen that multiple piston-pair engines are quite feasible.

This arrangement is advantageous in that the pistons 22, 22' never push against the coil spring 42 to transfer power to the cam 10. One resilient assembly 38, instead of two, is attached to the outer rods 32, 32' away from intense pistons 22, 22' heat. Access means 44, 44' located on cam case 19 eliminates engine teardown for adjustment of resilient assembly 38.

While there has been shown and described what are at present considered the preferred embodiments of the invention, it will be obvious to those skilled in the art that various changes and modifications can be made therein without departing from the scope of the invention defined by the appended claims.

I claim:

1. A power transfer mechanism for transferring power between rotating components and reciprocating components comprising:

a cam rotatable about an axis, said cam having an odd number of lobes evenly spaced therearound;

a double-acting reciprocating member comprising two diametrically opposed pistons, each of said two pistons having roller followers in operable relationship with said cam, and connecting means disposed between two pistons for resiliently urging said roller followers against said cam; and an access means in a cam case for adjustment of said connecting means.

2. A power transfer mechanism in accordance with claim 1 wherein said connecting means comprise:

(a) a plurality of piston interconnecting rods having parts which fit and slide one within another; and (b) adjustable resilient means.

3. A power transfer mechanism in accordance with claim 1 wherein said connecting means comprise:

(a) a plurality of piston interconnecting rods having parts which fit and slide one within another;

(b) a coil spring; and (c) adjustable means.

4. A power transfer mechanism for transferring power between rotating components and reciprocating components comprising:

a cam rotatable about an axis, said cam having an odd number of lobes evenly spaced therearound; and a double-acting reciprocating member comprising two diametrically opposed pistons, each of said two pistons having roller followers in operable relationship with said cam, and connecting means disposed between said two pistons for resiliently urging said roller followers against said cam.

* * * * *